US009554627B2

(12) United States Patent
Levi et al.

(10) Patent No.: US 9,554,627 B2
(45) Date of Patent: Jan. 31, 2017

(54) SLIDER FOR SLIDE FASTENER AND METHOD OF INSERTION THEREOF

(71) Applicants: Alberto Elías Levi, Buenos Aires (AR); Raquel Aini, Brooklyn, NY (US)

(72) Inventors: Alberto Elías Levi, Buenos Aires (AR); Raquel Aini, Brooklyn, NY (US)

( * ) Notice: Subject to any disclaimer, the term of this patent is extended or adjusted under 35 U.S.C. 154(b) by 0 days.

(21) Appl. No.: 14/435,389

(22) PCT Filed: Oct. 18, 2013

(86) PCT No.: PCT/US2013/065647

§ 371 (c)(1),
(2) Date: Apr. 13, 2015

(87) PCT Pub. No.: WO2014/063031

PCT Pub. Date: Apr. 24, 2014

(65) Prior Publication Data

US 2015/0296930 A1 Oct. 22, 2015

(30) Foreign Application Priority Data

Oct. 19, 2012 (AR) ..... P120103906

(51) Int. Cl.
*A44B 19/28* (2006.01)
*A44B 19/26* (2006.01)
(Continued)

(52) U.S. Cl.
CPC ..... *A44B 19/28* (2013.01); *A44B 19/02* (2013.01); *A44B 19/26* (2013.01); *A44B 19/262* (2013.01);
(Continued)

(58) Field of Classification Search
CPC ..... A44B 19/28; A44B 19/30; A44B 19/301; A44B 19/303; A44B 19/305; A44B 19/306; A44B 19/308; A44B 19/26; A44B 19/262; Y10T 24/2588; Y10T 24/2561; Y10T 24/2563; Y10T 24/2564; Y10T 24/2566; Y10T 24/2568; Y10T 24/257; Y10T 24/2571; Y10T 24/2573; Y10T 24/2575; Y10T 24/2577; Y10T 24/2579; Y10T 29/49783; Y10T 29/49782; Y10T 29/53291
(Continued)

(56) References Cited

U.S. PATENT DOCUMENTS 1,675,053 A * 6/1928 Rothschild ..... A44B 19/28 24/406
1,898,216 A 2/1933 Schade et al.
(Continued)

FOREIGN PATENT DOCUMENTS

JP 2010000331 A 1/2010
KR 1020100102020 A 9/2010
(Continued)

OTHER PUBLICATIONS

Certified copy of priority document, Argentina application No. P120103906 filed on Oct. 19, 2012.
(Continued)

*Primary Examiner* — Essama Omgba
(74) *Attorney, Agent, or Firm* — Conley Rose, P.C.; Rodney B. Carroll

(57) ABSTRACT

A slider for a slide fastener that is easily adjustable to a variety of sizes and types of slide fasteners, since it can be pivotally opened and closed horizontally and can be locked in the appropriate size according to the size of the slide fastener in which it has been previously inserted; the horizontal opening of the slider allows it to be inserted in both rows of teeth of a new or repaired slide fastener without unsewn parts of the garment or article of interest; addition-
(Continued)

ally a method for the insertion of the slider in a garment or article of interest to be manufactured and/or repaired is disclosed.

14 Claims, 7 Drawing Sheets

(51) Int. Cl.
*A44B 19/02* (2006.01)
*B29D 5/00* (2006.01)

(52) U.S. Cl.
CPC ..... *Y10T 29/49782* (2015.01); *Y10T 29/49783* (2015.01)

(58) Field of Classification Search
USPC ..... 24/415, 416, 417, 418, 419, 420, 421,24/422, 423, 424, 425, 430
See application file for complete search history.

(56) References Cited

U.S. PATENT DOCUMENTS

| | | | | |
|---|---|---|---|---|
| 1,919,946 | A | 7/1933 | Johnson | |
| 1,988,419 | A | 1/1935 | Gilmore | |
| 2,000,415 | A * | 5/1935 | Pannutti, Jr. | A44B 19/28 24/429 |
| 2,032,438 | A * | 3/1936 | Riecken | A44B 19/28 24/430 |
| 2,366,797 | A | 1/1945 | Legat | |
| 2,552,218 | A * | 5/1951 | Root | A44B 19/301 24/388 |
| 2,552,394 | A * | 5/1951 | Bloxsom | A44B 19/30 24/418 |
| 2,616,141 | A | 11/1952 | Morin | |
| 2,821,765 | A * | 2/1958 | Morin | A44B 19/28 24/416 |
| 2,977,656 | A * | 4/1961 | McNamara | A44B 19/26 24/417 |
| 2,989,802 | A | 6/1961 | McNamara | |
| 4,513,484 | A * | 4/1985 | Iblings | A44B 19/267 24/418 |
| 7,313,847 | B1 | 1/2008 | Felix et al. | |
| 8,539,651 | B1 * | 9/2013 | Williams | A44B 19/28 24/415 |
| 2010/0154179 | A1 | 6/2010 | Blackford et al. | |
| 2010/0299886 | A1 * | 12/2010 | Fodge | A44B 19/28 24/419 |
| 2015/0296930 | A1 * | 10/2015 | Levi | A44B 19/26 29/408 |

FOREIGN PATENT DOCUMENTS

| | | | |
|---|---|---|---|
| WO | 2014063031 | A1 | 4/2014 |
| WO | 2014063031 | A4 | 4/2014 |

OTHER PUBLICATIONS

Foreign communication from a priority application—International Search Report and Written Opinion, PCT/US2013/065647, Feb. 12, 2014, 11 pages.
Foreign communication from a priority application—International Preliminary Report on Patentability, PCT/US2013/065647, Apr. 21, 2015, 8 pages.

* cited by examiner

SLIDER FOR SLIDE FASTENER AND METHOD OF INSERTION THEREOF

CROSS REFERENCE TO RELATED APPLICATIONS

This application is a filing under 35 U.S.C. 371 of International Application No. PCT/US2013/065647 filed Oct. 18, 2013, entitled "Slider for Slide Fastener and Method of Insertion Thereof," which claims priority to Argentine Patent Application No. P120103906 filed Oct. 19, 2012, which applications are incorporated by reference herein in their entirety.

FIELD OF THE INVENTION

The present invention relates to the fields of haberdashery, luggage, bags, garments and the like, since it relates to the use of slide fasteners, and in particular to a slider that slides along the fastener causing it to open and close; and yet more specifically the present invention relates to a new slider for a slide fastener, which is capable of adjusting to a variety of fastener sizes and types and which is suitable for easy replacement of damaged sliders without changing the original seams of the article to which it is attached.

DESCRIPTION OF RELATED ART

To better understand the purpose and scope of the present invention it is appropriate to give a brief description of the art related to this type of sliders for slide fasteners and more specifically, a description of those types of sliders which are the nearest reference to the present invention, to best highlight the innovations characteristic of the new slider proposed herein.

By way of introduction, and as is well known to a person skilled in the art, a typical slide fastener usually is applied to the longitudinal openings of garments, such as jackets, trousers, sweatshirts and shoes, or articles as varied as bags, pockets, wallets, cases, covers and even tents, sleeping bags, purses, etc, as well as to an ever increasing variety of everyday items.

A slide fastener consists generally of two fabric tapes or bands parallel to each other with two separate rows of small metal or plastic teeth distributed longitudinally on one of its edges so that they can be interwoven or interlocked with each other. When moved in one direction, the slider causes the teeth on one tape to interlock with the teeth on the other tape, and when moved in the opposite direction the teeth are disengaged. The slider is primarily responsible for the teeth of both fabric tapes to join or separate in order to release both sides of the garment or object, so that the opening and closing of the zipper is obtained by sliding said slider to either side.

Slide fasteners are so versatile, useful and functional, that they have evolved into a variety of shapes, colors, sizes, materials and designs. Because slide fasteners allow to open and close considerable lengths of clothing and other items quickly and effectively, they are almost essential for use in jackets, trousers, bags, etc. However, as most of parts or moving parts subject to heavy use, the slide fastener usually deteriorates long before the rest of the article. For this reason, if the slider is damaged, as is often the case, either by partial breakage or deterioration, it is necessary to replace it in order to continue using the garment.

It is worth mentioning that although for the purpose of the present invention and in order to facilitate reading and understanding what is herein disclosed, mention is made of replacement of slide fasteners in clothing, it will result clear to a person skilled in the art, that the same concepts are transferable to bags, shoes, cases, tents, covers and any other object, there being no impediment to do so.

Whenever a slider has been damaged or broken, its replacement on the slide fastener by conventional methods generally requires at least partially unsewing the fabric tapes to allow inserting a new slider similar to the original one. This is a time-consuming task and requires an experienced person to avoid damaging the article. Usually replacing the slider on an article is a costly and hard-working task, and even impractical if the breakage or damage occurs when the user of the article is far from his or her home or from a zipper repair shop, thus not having access to the necessary tools, resources and services needed to carry out its repair.

It is noteworthy that the need for the fabric tapes or bands of the slide fastener to be unsewn is closely related to the type of making of the article to be repaired; for instance, high quality warm jackets, in general require a more time-consuming work to unsew the cloth because they have a combination of fabrics and fillers, since the slide fastener is attached to the different layers of the garment in a more complex way.

A conventional slider of the type that is provided with an article has a typical design with a double channel, i.e., a channel for each row of teeth and a wedge-shaped central splitter. Each channel for each row of teeth has a pair of outermost guiding tabs that continuously interfere or push the rear part of the teeth of each row of the slide fastener so to guide and retain them in position during the closing process. It is for this reason that, since it is necessary for the guide tabs to push the teeth inwards, the structure of a conventional slider is not especially designed to be inserted after the article has been made, so that if it were necessary to insert a new slider between both rows of teeth, this would only be possible if done from one end of the slide fastener (by unsewing the garment or article to which it is sewn) in order to avoid interference between the teeth and said guide tabs which are necessary for the operation of the slide fastener.

This drawback in the installation of a replacement or a new slider has been noted by some manufacturers and persons skilled in the art, who in order to facilitate the insertion of a new slider in a slide fastener without the need to unsew significant parts of a garment or article, have developed and disclosed different designs providing a temporary vertical opening of the slider itself, by providing the slider of an upper part and a lower part, so that the guide tabs will not interfere with the teeth of the slide fastener at the time of being inserted, by vertically moving away far enough. A typical example of this type of proposed solution can be seen in U.S. Pat. No. 7,313,847 which presents a replacement slider provided with an upper part and a lower part to allow inserting said slider in a slide fastener without having to unsew it. The basic principle is that the lower and upper parts are brought together and moved away from each other, allowing the teeth not to interfere with the upper and lower guide tabs during assembly, and then said upper and lower guide tabs are brought together, embracing both rows of teeth of the slide fastener as a common integral slider; therefore in general such invention only proposes to disconnect a traditional slider temporarily at the time of insertion to reattach it as if it would have been integrally constructed once assembled. Many other proposals have been made by applying the same approach, in order to obtain a slider that can be vertically opened to allow it to be assembled on a double row of teeth already sewn on a garment or article of interest; however, these solutions only apply to a single size of slide fastener teeth corresponding to each slider marketed, but they do not show or disclose any type of adjustment to the width or size of the slide fastener teeth.

While this type of technical solution and some other similar proposals appear to solve this problem by avoiding to unsew garments or objects, they only partially solve the problem, since each replacement slider of this type can be used solely with a specific size type of slide fastener, therefore when repairing or replacing a slider, special attention should be given to selecting the specific slider size for a specific size width of the slide fastener teeth, and consequently one must also keep a specific replacement slider size in stock in order to be able to repair the corresponding size of damaged slide fastener.

As a person skilled in the art knows, slide fasteners are provided in a variety of sizes and materials, so as to adjust most suitably to the size and requirements of the garment or article on which the slider fastener will be attached. Usually, slide fasteners are successively numbered, for example #3, #4, #5, #6, and so on, which means that the width between the back of the teeth once embedded is 3 mm, 4 mm, 5 mm, 6 mm, etc. respectively; such size range of the teeth of the slide fastener corresponds to a similar range of the required slider sizes, therefore not all sliders fit all slide fasteners.

A clear example of this limitation in the prior art of this type of replacement sliders regarding sizes, is that their manufacturers offer a predefined set of measures to cover the range of sizes of commercially available slider fasteners, so that when replacing a slider one must first measure or try out which specific slider of said set of sliders fits best the slide fastener being repaired. In addition to the foregoing, a vertically detachable replacement slider does not take into account aesthetic and functional qualities that are highly appreciated by users as they usually include very small manual adjustment screws, which are difficult to tighten and handle and often require using special tools for tightening or loosening. Additionally, the design proposed in the mentioned patent document includes some kind of spring that is typically visible, making it too obvious that the slide fastener has been repaired. Also, replacement sliders in general are considerably larger than the conventional slider that they are replacing.

It is also worth mentioning that there are other solutions which at first glance might appear to have certain geometric similarity with the present invention, but in general they are solutions only designed to achieve a certain degree of partial disassembly or braking of the slider of the slide fastener. One example of this is shown in the patent documents of the state of the art closest to the present invention, which will be indicated below for reference purposes, but clearly they also fail to provide clear advantages of adapting the slider itself to a variety of slider fastener tooth sizes, and they are also not intended to be completely disassembled to be used as a replacement part for any form type and size of the teeth of a slide fastener.

In U.S. Pat. No. 1,919,946, Johnson discloses a slide fastener that allows removing the slider from one of the slide fastener stringers, the slider having a fixed part and a movable part pivotally connected to the fixed part. The movable part, when rotated, releases one of the tapes supporting one of the rows of teeth of the slide fastener, but the fixed part is still attached to the remaining stringer which supports the other row of teeth of the slide fastener. Therefore it does not illustrate, describe or imply any possibility of completely removing the slider. The movable part is frictionally gripped by a flange 7 that is held by portion 13 and member 9 and to be freed it must be pushed by the projection of the pull tab. The aim of this slider for slider fasteners is to realign the two parts of the fastener; if its teeth are not correctly aligned. This invention fails to disclose or suggest any motivation for the slider to fit different sizes of the teeth of the fastener, so it only supports its installation in a particular type of fastener size and does not disclose in any way a manner to completely remove the slider from the stringers.

In U.S. Pat. No. 1,988,419, Gilmore discloses a separable fastener of the slider-operated type and particularly to means for retaining the slider against accidental movement on the fastener stringers. The slider has a pair of tabs responsible for pushing the rows of teeth of the stringers against each other, with said tabs integrally connected through a pair of wings to a neck portion. Gilmore proposes that the wing is split along a longitudinal line to form two sections which can move away and approach each other flexibly. A lug on the split top wing has two extensions which, in turn, have inclined surfaces so that when the pull tab is pushed down, said extensions come together and consequently the two tabs approach one another to push both rows of teeth of the slide fastener tapes against each other and thereby act as a friction brake on the slider. The slider proposed herein cannot be removed from both tapes of rows of teeth of the fastener, and cannot adjust its geometry to accept different sizes of teeth, it is limited only to stop the slider in a desired position.

In U.S. Pat. No. 1,898,216 Schade et. al describe a new construction of a slider for a slide fastener of particular interest for application on books. It is explained that sometimes the slider is designed to be completely separated into parts in order to allow to completely open a book. These slider constructions which come apart have the defect that it is not a simple matter to get the two rows of prongs and the slide assembled for the closing operation, and therefore they propose to construct a new type of slider which will pivot for opening purposes. The slider consists of two halves. Both halves have lugs cooperate between them and then are secured by a third piece which locks and unlocks both halves with respect to their condition for pivoting around the pivot itself. As shown, the pivot is located towards one end of the slider, while the split splitter is located on the other end, since the split splitter is responsible for separating both rows of teeth of the two slide fastener tapes, we can clearly see that the two halves of the slider are not designed to be separated from said rows of teeth, and let alone to adjust the tightening width of the rows of teeth that are engaged when pulling the slider to close the fastener. This fails to suggest or disclose how to completely remove the slider from both tapes with the rows of teeth. This slider is proposed for particular cases as in the construction of books, in which a slider separable into two parts, allows the opening of the fastener, i.e., to travel the three sides complementary to the book spine, without having to resort to an "extra-travel" to obtain the full opening of the book. Therefore such patent merely discloses a constructive type of slider for a single measure of fastener element in order to obtain the separation of both tapes of teeth of the fastener, but without further consideration regarding the use of the slider as a universal replacement and/or use thereof in different sizes of teeth of the fastener by the same slider.

In U.S. Pat. No. 2,616,141 Morin describes a self-locking slider comprising a pair of attached parts adapted to abut each other when two halves of the slider, generally similar, pivot around a flange portion; this allows a contraction of the narrower end of the slider obtaining a working strain of the teeth immediately close to the narrow end of the slider, thereby allowing to retain the slider in a fixed position. The pulling outward of both tapes supporting the two rows of teeth that normally would force the sliding and opening of the fastener, in this case this helps to lock the position of the slider by a clamping effect. Moreover, it is possible to obtain a continuous brake part effect inserted into a spring to force the tightness of the narrow end portion of the slider (see FIG. 4 of U.S. Pat. No. 2,616,141). This invention fails to show or describe that the slider can be removed and fully inserted into a new set of stringers with rows of teeth of a new fastener, let alone any way that the slider fits different sizes of teeth of the fastener since it only limits to propose a new type of lock or brake of the slider.

In U.S. Pat. No. 2,977,656 and later in U.S. Pat. No. 2,989,802 both of the same inventor, McNamara proposes a slider that can be assembled onto the stringer tapes carrying the rows of teeth of the slide fastener after the same have been sewn to the garment or article of interest, particularly when the space for the sewing of the slide fastener is very narrow and the slider would interfere with the sewing machine. The slider consists of several separable parts, in U.S. Pat. No. 2,977,656, in FIGS. 1 to FIG. 5 of said patent the inventor proposes a slider with two main parts pivoted between each other, connectable by a rod passing through them, though this is not determinant, since FIG. 6 to FIG. 9 of said patent do not illustrate said pivot as necessary, because its purpose is just to split the slider into two halves that abut against each other so as to secure the two halves are fixed together by a locking clip received by external peripheral grooves in each half of the narrow end of the slider. This slider must be selected or provided for a given size of fastener. It does not support an adjustment of the size of the teeth by a single slider. The type of tabs and channel slider proposed therein, do not show, propose or disclose a manner to solve the insertion of the slider in a standard double row of teeth, either for plastic, metal or spiral teeth. However the invention described in these latter two patents mentioned herein as prior art must necessarily use a specially designed row of teeth, with the spines of the teeth completely uncovered. This is reflected in the arched profile of both arms of the slider, since it lacks the top, bottom, left and right typical double set of teeth guide tabs, and the problems that it would cause when trying to assemble a traditional-type slider. At no time the invention illustrates or describes how this slider design should be incorporated into a standard double fastener for which the present invention is intended. Clearly, the arched arms must fully embrace the back of the teeth from one side of the stringers. This is not possible in the standard double row of teeth, since it would cause a deformation of the fabric of the tapes supporting the teeth of the slider fastener which would tend to push the slider to disengage it from the fastener. The limitation of this invention to a particular type of double-row of teeth of a fastener is clearly disclosed in column 3, lines 52 to 57, of U.S. Pat. No. 2,989,802, wherein the double row of teeth is not the one commonly used as standard at present, but it must be of a special type mentioned as welted inside edges, which is absolutely necessary to use the slider in U.S. Pat. No. 2,977,656. Clearly a person skilled in the art understands that a slider of the type proposed in these two latter patents mentioned cannot be applied to the stringer tapes carrying the teeth of the fastener of the type that is applied to the present invention.

Therefore, and according to what has been described above with respect to the prior art and in order to meet the market need of having a slider for a slide fastener easy to be installed or replaced, a new type of slider for a slide fastener is proposed such as illustrated and described below in the present invention.

BRIEF DESCRIPTION OF THE INVENTION

One of the aims of the present invention is to provide a slider for a slide fastener to be inserted into a slide fastener easily and efficiently without requiring unsewing parts of the garment or article which includes the slide fastener.

Another aim of the present invention is to provide a slider for a slide fastener which can be adjusted to a wide range of sizes of slide fasteners so as to be adaptable to different sizes and shapes of the teeth of the slide fastener with a single adaptable slider, at least in a reasonable range of frequently used sizes, and without having to resort to a set of sliders of different sizes.

Another aim of the present invention is to provide a slider for a fastener to be used as an easily installable slide fastener, as an original or replacement slider having an adjustable size, without this being in detriment to the aesthetic qualities expected for such products or having disproportionate dimensions as regards the size of the conventional sliders it would be replacing.

Another aim of the present invention is to extend the life of garments and articles in general since it offers an easy and economical way of repairing the slide fastener when its slider has been broken, as the user will not be tempted to prematurely discard said garment or article due to the inconvenience and cost that will currently represent to repair such garment or article.

Another aim of the present invention is to provide through the use of said slider the possibility of changing the original direction towards which the closing and opening of the slide fastener was initially predetermined, allowing the user to manipulate the slider so that the slide fastener that could be closed from left to right can now be modified and opened and closed by the user in the opposite direction, while allowing to easily add at least a second slider on the slide fastener in the opposite direction to the other, it is possible to provide it with a double opening, as in the case of backpacks, luggage, large tents and other items requiring a wider and lengthy opening. In this way an added value is provided to the garment and/or article on which such action and installation of this slider was performed. Likewise, thanks to its easy and fast installation and removal this new slider, the user is also able to insert and use at least a second slider that can be connected together with the original slider or some other slider that has been previously installed through any media and/or safety device (e.g.: lock), thus providing more security to the article on which it was installed, thus preventing others from opening, forcing and stealing any items that the user wants to protect and keep out of reach from others.

With these aims the present invention provides a slider for a slide fastener of the type used for sliding along a pair of rows of interlocking teeth, where each row of teeth is attached to fabric tapes or flexible bands that act as stringer tapes of said teeth, being said stringer tapes generally attached to the longitudinal opening of garment or articles either by seams, adhesives or the like to open and close the longitudinal opening, so that said slider has a left portion that includes a pair of left guide tabs vertically separated from each other by a space for the passage of the stringer tape carrying said teeth. It also has a complementary right portion which includes a pair of right guide tabs vertically separated from each other by a space for the passage of the stringer tape carrying said teeth, wherein said left portion and said right portion can be connected to each other through a connecting device either integral to both portions or connectable to such portions such that said guide tabs of said left portion and said right portion may be detached and attached horizontally and adopting different horizontal approximation distances and a locking device which allows to fix said horizontal approximation distance existing between said left and right guide tabs.

Other objects and advantages of the present invention will become apparent from the following detailed description of the invention taken in conjunction with the accompanying claims.

BRIEF DESCRIPTION OF THE DRAWINGS

For the purpose of clarity and understanding of the subject matter of the present invention, the same has been illustrated in several figures, in which the invention has been represented in more than one preferred embodiment, all by way of example, wherein:

FIG. 13*a* illustrates a slider suitable for use in slide fasteners that never completely detach both rows of teeth, and FIG. 13*b* illustrates a slider suitable for use in a slide fastener which, when opened completely it completely detaches both rows of teeth.

DETAILED DESCRIPTION OF THE INVENTION

Figure 1:
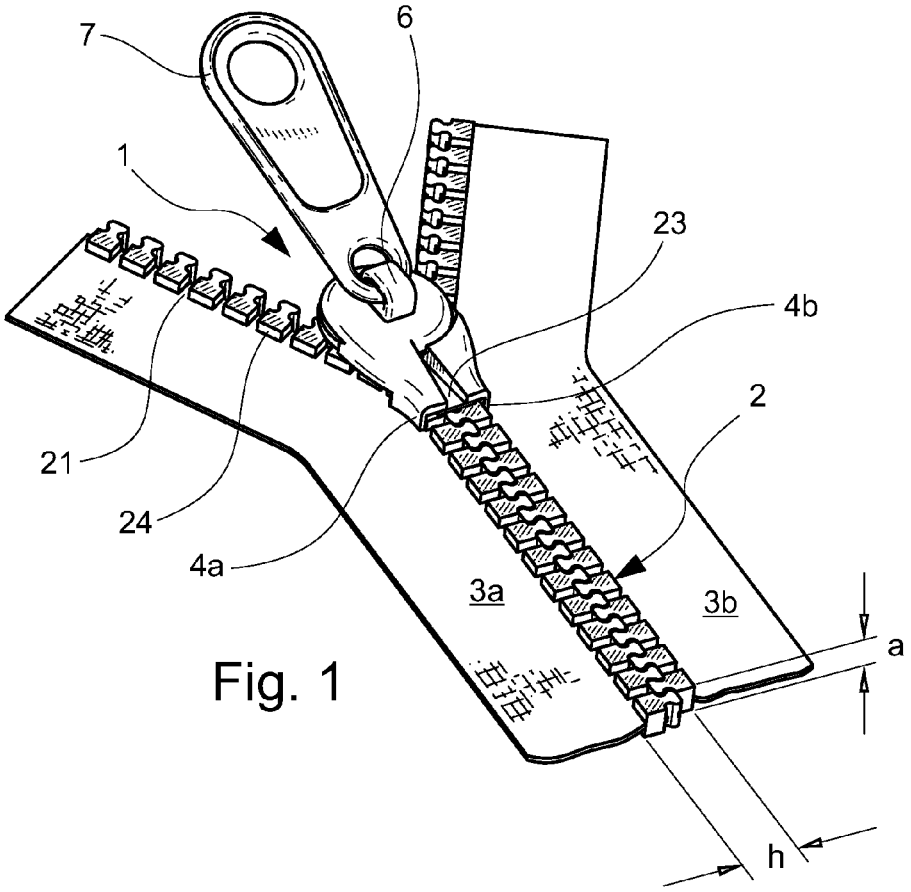
FIG. 1 is a perspective view of the general appearance of a slide fastener having the slider implemented according to a first embodiment of the present invention.

As shown in the accompanying figures the slider for a slide fastener according to a first embodiment, which is best illustrated in FIG. 1, at first glance is very similar to that usually observed in slide fasteners, namely a slider (1) of the type used for sliding along a pair of rows of teeth (2) interlockable with each other, wherein each row of teeth is supported on stringer or flexible fabric tapes or bands (3) which are generally attached to the longitudinal opening of garments and various articles by seams, adhesives or the like to achieve the longitudinal opening and closing thereof. However the present invention comprises certain features considered novel and inventive and which are detailed below.

FIG. 1, by way of preferred example illustrates a slide fastener of the type known as "plastic teeth." The teeth (2) of both rows or lines are interleaved or intertwined out of one end of said slider (1) (downward in the figure) and instead they are separated or unlinked to each other as they come out of the other end of said slider (1) (upward in the figure). In order to better illustrate the adjustment of this new slider (1) to a variety of teeth sizes (2), we have selected by way of example, a common and frequent tooth size, whose nominal size derives from taking the measure existing between the spines (24) of both rows of teeth in an interlocked position, which for FIG. 1 of the example is of 6 mm (width) (h), which in the jargon would be a #6 slide fastener.

It is worth mentioning that the width dimension (h) is taken between the farthest ends of two locked teeth; i.e., interlocked, i.e., between the spines (24) of the interlocked teeth, which will de called hereinafter as "width (h) of the interlocked teeth" or simply as "width (h) of teeth". This width dimension (h) of interlocked teeth of about six millimeters is usually one of the most frequently used measures used on clothing, such as that commonly found in trousers and has been used just as an example, so it does not limit in any way the scope of the present invention to other teeth sizes, shapes and designs.

The inventors of this new slider (1) have observed two recurrent aspects in the slide fasteners available in the current state of the art. These aspects, which apparently have not been perceived by slide fastener manufacturers, surprisingly have allowed to carry out the present invention. One of the aspects observed, is that although the increase of the fastener sizes (#3, #4, #5, etc) is due to an increase in width (h) between the rows of interlocked teeth and to an increase (significantly lower) of the height (a) of said teeth, notably the thickness of the fabric stringer (3) tapes of said teeth, generally speaking does not change significantly, therefore the increased height (a) a well as tapes thickness (3) for all practical purposes are of little relevance to the increased width (h) of the interlocked teeth.

To illustrate this situation, it can be objectively said that a variation of the "width (h) size of interlocked teeth" within a range that goes from 4-10 mm (#4 to #10 slide fastener sizes) was consistent with very small thickness variations of the fabric tapes (3) which remained within a range of 0.7 to 1.1 mm. While there was a slight height variation (a) of the teeth that remained within a range of 2.1 to 3.8 mm. This clearly demonstrates a small variation in the height (a) of said teeth and an almost non existent thickness variation of the tapes (3) with respect to the variation of the other dimensions, particularly with respect to the width (h) among teeth.

As a second aspect, it was also noted that while slide fasteners allow to obtain a continuous locking effect on the garment or article, for practical purposes there is an actual separation (21) between consecutive teeth (2) for the same stringer (3) tape of said teeth. It is understood that this separation (21) between consecutive teeth of the same row of teeth gives the fastener certain flexibility to facilitate the opening and closing of the slide fastener by sliding the slider and therefore, in some way or another it is always present. In other words, such separation (21) between consecutive (2) teeth is present in different geometries, but occurs repeatedly whatever the shape type or manufacture of the fastener element, as in the main types of teeth known and used at present, such as plastic, metal or spiral teeth.

Interlocking between the teeth (2) of both stringer (3) tapes of said teeth is mainly due to the guiding or channeling caused by the slider (1) on both rows of teeth (2) in such a way that the guide tabs (4) can effectively push or trap both rows of teeth (2*a*, 2*b*) against each other, so that the teeth progressively embed/interlock among them as the slider slides towards the closing direction.

Guide tabs (4) are distributed so as to have two of said guide tabs (4) above the tapes (3) and two of the same below the tapes (3), maintaining a sufficient vertical spacing to allow to slide the tapes between them (3). The vertical separation between guide tabs (4) can be referred to as "vertical separation (s) between tabs for tape passing (3)". As has been mentioned with respect to prior art, the solution principle for repair and/or interchangeable sliders today rely on modifying said vertical separation(s) between tabs for the passage of the tapes (3), in such a way as to increase by some means such vertical separation(s) so that it becomes greater than the height (a) of the teeth (2) and so they can allow the teeth to pass inside the slider (1), in order to close again the vertical space(s) to ensure that the teeth of both rows become locked.

Figure 2:
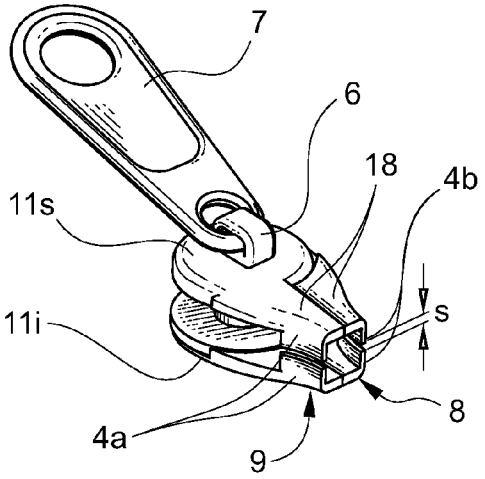
FIG. 2 is a perspective view and generally from the front of the slider for a slide fastener according to the first embodiment of the present invention, in the closest position it can take.
Figure 3:
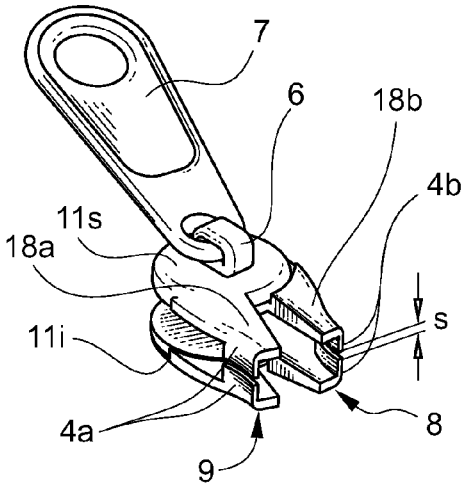
FIG. 3 is a perspective view and generally from the front of the slider for a slide fastener according to the first embodiment of the present invention, in a more open position with respect to FIGS. 1 and 2.

On the contrary, the proposed solution according to the present invention, and as best illustrated in relation to FIGS. 2 and 3, does not need to modify the vertical separation (s) between tabs for the passage of the tape, but it allows to adjust in a novel and inventive approach the horizontal approaching distance between the guide flaps (4), in order to fit the width (h) of the interlocked teeth to which it may be necessary to incorporate, add, replace and/or repair the slider.

The left guide tabs (4*a*) and the right guide tabs (4*b*) respectively included in the left portion (9) and in the right portion (8) of the slider (1) are vertically separated from each other by a space (s) for the passage of said stringer tapes (3*a*, 3*b*) of said teeth. Therefore said space of vertical separation between the top and bottom guide tabs is sufficient to allow the passage of the larger-size fastener tape thickness to which one wishes to adapt, and being that the tape thickness varies little in a wide range of fastener sizes, said upper and lower guide tabs may be vertically separated from each other by a fixed space (s), preferably by having a value within the range of 0.7 to 1.2 mm. More preferably in a space(s) of vertical separation between top and bottom guide tabs of about 0.75 mm. This numerical example described above, in no way limits the adoption of other larger or smaller measures to be considered and is incorporated herein only for the purpose of representing a mere exemplification of a possible situation that can be put into practice.

It is worth mentioning that the left and right definition referred to the slider (1) and for purposes of the present invention is merely a convention for the sake of clarity of identification the slider portion (1) being referred to, and it is clear to a person skilled in the art that the reference to the left or right portion is generally associated with particular characteristics shown in the figures and do not constitute any limitation for the purposes of protection, since such reference could be reversed, by way of example, in the accompanying figures usually when the left portion (9) has been mentioned, in general it refers to the part that is more visible or is more external when displaying a pivoting adjustable slider (1) and such reference has been kept throughout the description only for clarity.

It is then that the present invention allows to have a slider (1) for a slide fastener that according to the first embodiment illustrated in FIG. 2 has a horizontal approaching distance between pairs of guide tabs (4*a*, 4*b*) smaller than that illustrated in FIG. 1, such as for example to a #3 or #4 measure, and in FIG. 3, the slider (1) already calibrated to a greater horizontal approaching distance measure between guide tabs (4), such as #8 or #9, etc, without necessarily having to change the vertical separation distance (s) between top and bottom guides tabs of the same portion (8 or 9) of the slider (1).

This change in the horizontal approaching distance between tabs (4*a*, 4*b*) determines a variation in the shape of the rectangular window through where both rows of teeth (2*a*, 2*b*) tightly appear as the fastener is being closed. It is worth mentioning that for purposes of the present invention, the horizontal approaching distance between tabs (4*a*, 4*b*), is not necessarily the most protruding front end of the slider (1) but rather the narrower tightening distance formed between both pairs of guide tabs (4*a*, 4*b*), i.e., between the left guide tabs (4*a*) and the right guide tabs (4*b*) being what determines in general a rectangular tightening window of the teeth (2).

In relation to this horizontal adjustment of the guide tabs (4) we have surprisingly found that if the horizontal approaching distance between the tabs (4) generally coincides with the measurement of the width (h) of the interlocked teeth, this causes an effective closing of the fastener when sliding the slider (1) towards the closing direction (as shown in FIG. 1). It is noteworthy that both rows of teeth (2) together with the guidance obtained for both fabric tapes (3) and the pushing of the guide tabs (4*a*, 4*b*) act in combination to ensure the proper operation of the slide fastener, as effectively as would a conventional slider.

This functional adjustability of the new slider (1) proposed herein allows a single slider to be capable of fitting a variety of sizes and types of fasteners to replace the original and/or damaged slider.

However, having described in general the way in which the slider (1) of the present invention can be effectively adapted to a variety of fastener sizes, below we will describe in detail the characteristics allowing said slider to be inserted and adapted to be used either as an original slider or as replacement of a damaged slider without unsewing or modifying the garment or article that is being repaired.

Figure 4:
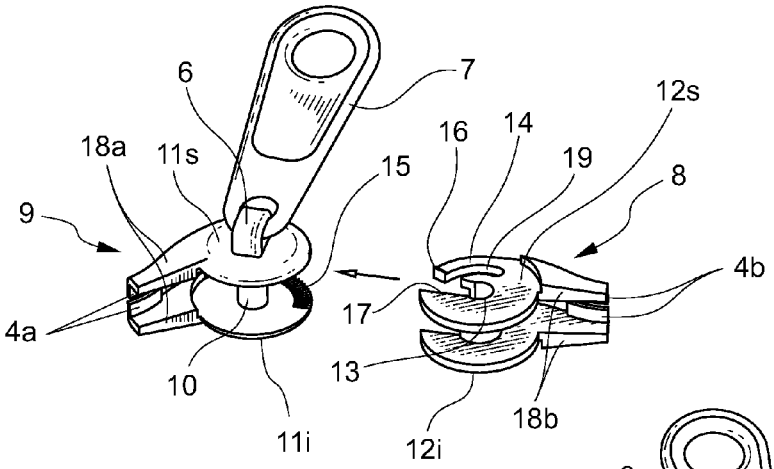
FIG. 4 is a perspective view and generally from the front of the slider, with some of the separate component parts before being assembled together, according to the first preferred embodiment.
Figure 5:
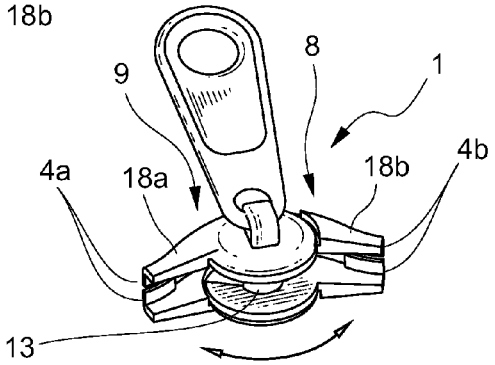
FIG. 5 is a perspective view and generally from the front of the slider, with its parts already assembled, on the most suitable position for inserting into or removing said slider from both tapes of the slide fastener, the hollow double-headed arrow indicates the relative movement between the two parts (back and forth).

The drawing of FIG. 4, shows a slider (1) according to the first embodiment of the present invention, wherein two separable pieces are illustrated as reels (8, 9) connectable to each other to obtain the slider in FIG. 5.

FIG. 4 shows a left reel (9) which for the purposes of this invention conforms the left portion (9) of the slider (1), which in its preferred embodiment provides a generally cylindrical column (10) that allows to keep together, and at a predetermined vertical distance, a pair of covers (11*s*, 11*i*), which are identified as bottom cover (11*i*) and top cover (11*s*), being said top cover (11*s*) in its preferred embodiment connected to an ear or ring (6) which can rotate freely and which in turn is connectable with a pull knob (7) which may be of a known type to facilitate the attachment of the slider by the user of the garment or article, or with any other type of element(s) that can be used for such purposes.

There is also a right reel (8), that for the purposes of the present invention forms the right portion (8) of the slider (1) having a connection housing (13) generally tubular but open through an insertion groove (17) as a hollow pseudo-column so as to allow insert the column (10) of the left reel (9) to be secured inside the connection housing (13). For this purpose, the connection housing (13) ends in the insertion groove (17) with a measure slightly less than the diameter of the column (10), generating an interference at the time of insertion of the column (10) inside the housing (13) securing a pivoting fitting serving as means of attaching said left portion (9) and said right portion (8).

According to the foregoing description, it is clear that the left portion (9) and said right portion (8) of the slider (1) are connectable to each other via a connecting device (10, 13) such that said guide tabs (4*a*, 4*b*) of said left portion (9) and said right portion (8) can horizontally detach and attach between themselves adopting different distances of horizontal approach, which for the purposes of the present invention, is generally coincident with the distance (h) between both spines (24) of the interlocked rows of teeth (2*a*, 2*b*).

Figure 10:
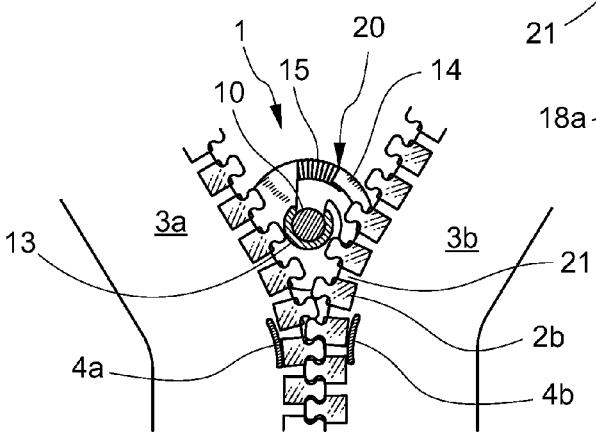
FIG. 10 is a top and sectional view through a plane passing over the teeth of the fastener of the slider already inserted in said fastener, showing the interaction of the guide tabs on the teeth to close them, and the column that separates the teeth.
Figure 11:
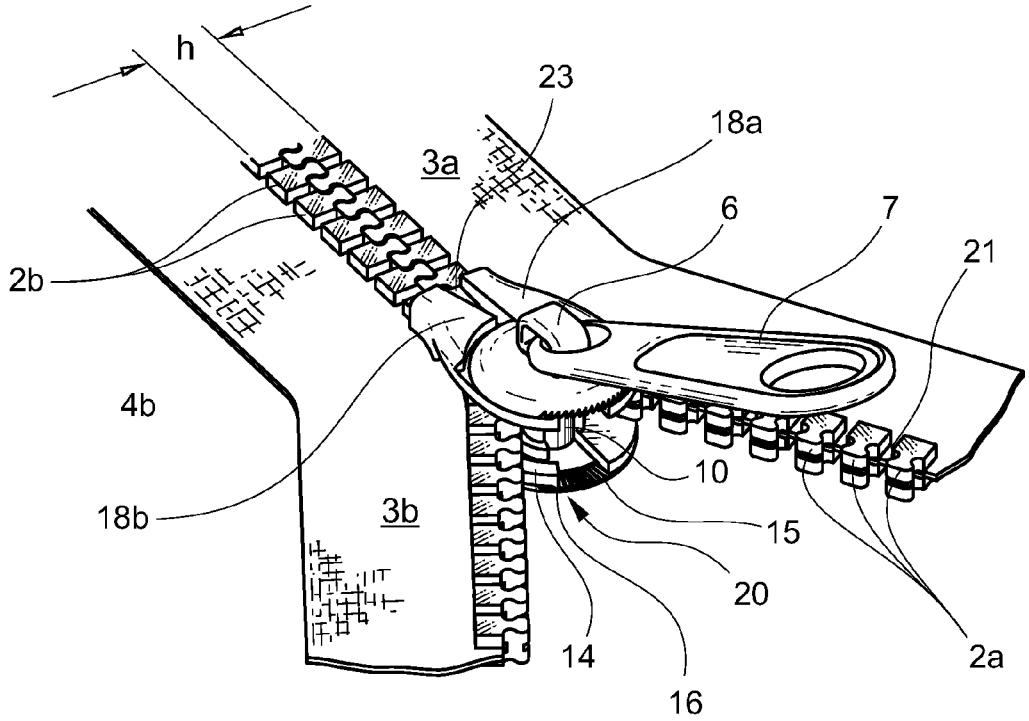
FIG. 11 is a perspective view from the back of the slider for a fastener according to the first embodiment of the present invention, better illustrating the locking device of the use position for one of the possible sizes of application.

To ensure the connection between the parts (8, 9), the insertion groove (17), where the column (10) is inserted towards the connection housing (13) is positioned at least with a suitable inclination as the one illustrated in FIGS. 4 and 10 or greater, so as to ensure that both parts are conveniently connected during everyday use of the slider (1). According to what has been described so far, it is obvious to a person skilled in the art that other ways of implementing said attachment device between said left portion (9) and said right portion (8) are also possible without departing from the spirit and scope of what is herein disclosed.

Covers (12*s*, 12*i*) for the right reel (8) are attached through the tubular pseudo-column generated by the connection housing (13) at a suitable vertical distance so that they will fit inside the covers (11*s*, 11*i*) as illustrated in FIG. 5 and once both parts (8, 9) are inserted, enabling the slider (1) to modify the horizontal approaching distance between the pairs of guide tabs (4*a*, 4*b*). The vertical distance between the top cover (12*s*) and bottom cover (12*i*) of the right portion (8) that according to the first preferred embodiment is also partially internal to the left portion (9) is high enough to enable sliding the larger element height (a) (2) of the fastener expected to be used, for purposes of example, if the slider could be adapted at most to a #8 slider fastener (i.e., 8 mm wide (h) of interlocked teeth), the predetermined vertical distance between the top cover (12*s*) and bottom cover (12*i*) could be set from 3.8 to 4 mm.

The foregoing values given by way of example, in no way limit the adoption of other higher or lower values, as well as incorporating some type of plastic or any other appropriate material small metal plate (23) to act or not elastically for the purposes of completing the slider aesthetically and contributing to slightly push the teeth (2) from above, from below and/or from both sides in the case of being elastic. Regarding the complementary and aesthetic parts, which may be incorporated to the slider (1), the same will be exemplified later on in FIG. 14 as they are in accordance with the current understanding and knowledge of the inventors of the present invention, mere add-ons of the main invention described herein.

For the particular case of FIG. 5, the attachment device between both right and left portions (8, 9) of the slider (1) is embodied as a mobile attachment between both reels (8, 9) that adopts the design of a pivotal attachment regarding column (10) inserted in the housing (13), therefore, for this particular design, the relative rotation between both portions (8, 9) determines a variation in the horizontal approaching/separation distance between the pairs of left guide (4*a*) and right guide tabs (4*b*), which is suitable to accommodate to different widths (h) of the interlocked teeth as illustrated in FIGS. 1 to 3. It is also possible to obtain horizontal approaching distances between pairs of guide tabs (4*a*, 4*b*) as extreme as in FIGS. 5 and 6 so as to allow insertion of said guide tabs (4*a*) or (4*b*) between the separation spaces (21) of two consecutive teeth of the same tape (3*a*) and (3*b*) as illustrated in FIG. 6.

Figure 6:
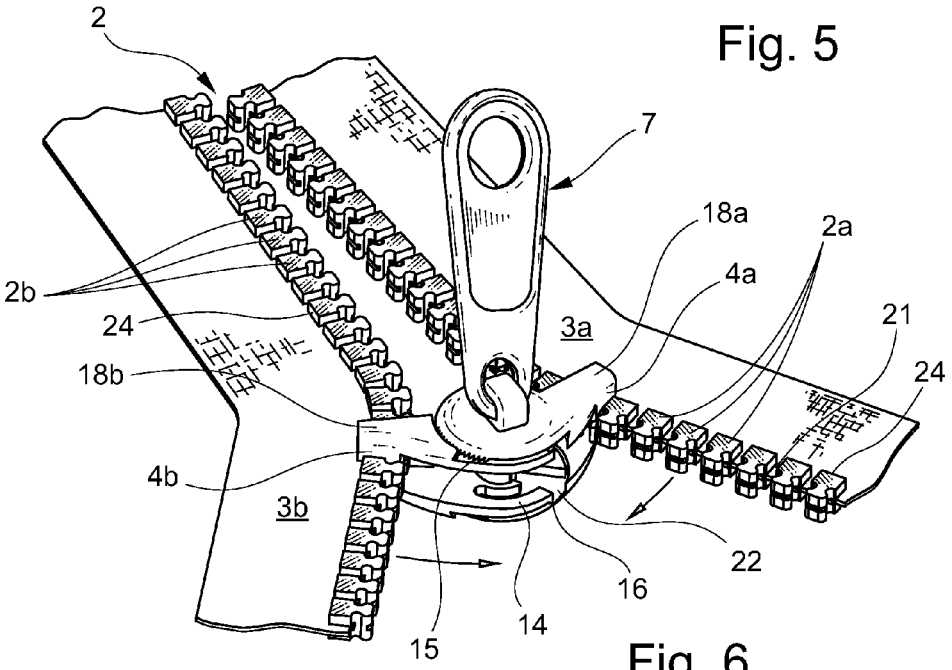
FIG. 6 is a perspective view and generally from the back of the slider, with the same being inserted between the teeth to carry out the installation of the proposed slider on the slide fastener.
Figure 7:
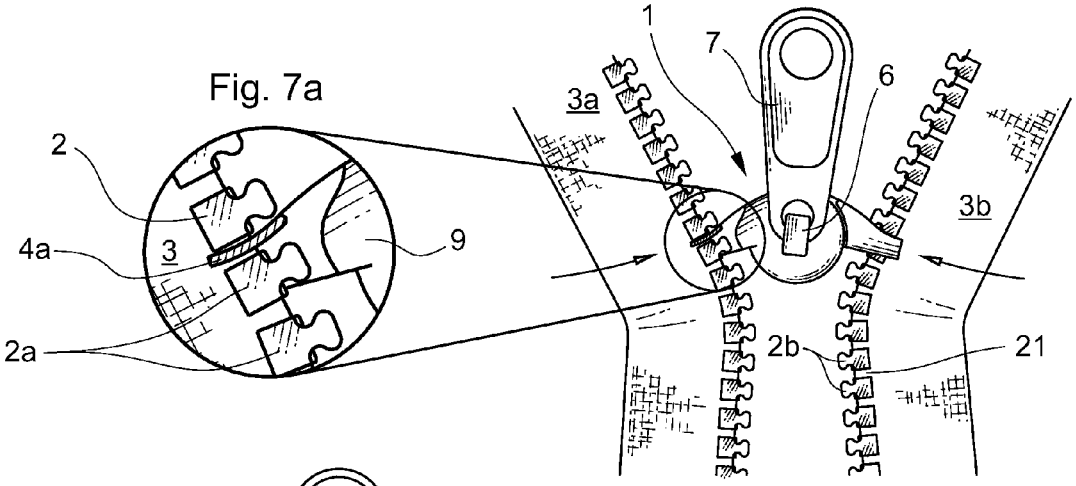
FIG. 7 is a top view of a slide fastener at the time of introducing the slider of the present invention, incorporating an enlarged detail 7*a* which shows the passage of the guide tabs between the teeth of the fastener.
Figure 8:
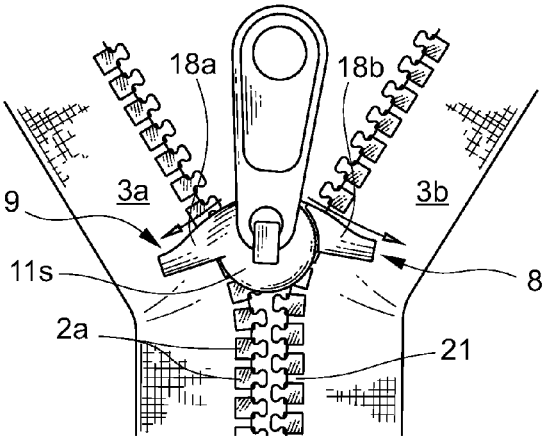
FIG. 8 is a top view according to FIG. 7, having forced the rows of teeth of both tapes to be conveniently inserted inside the slider.

For greater clarity, FIGS. 6 to 8 clearly illustrate the manner in which the slider (1) of the present invention allows to insert the pairs of guide tabs (4*a*, 4*b*) of each left (9) and right (8) portion of the slider (1) through the separation (21) between consecutive teeth of the corresponding row of teeth (2*a*, 2*b*) of each stringer tape (3*a*, 3*b*) of said teeth of the fastener, so that both tapes (3*a*, 3*b*) can approach one another, until both rows of teeth (2) are close enough to remain inserted into the slider (1), obtaining a kind of interlocking of the guide tabs (4) between the teeth.

The enlarged detail in FIG. 7*a*, clearly illustrates the thickness, length and geometry of a typical tab of this invention that is adequate to allow its insertion through the majority of the teeth (2) of the fastener of interest. For practical purposes, and as a reference, a suitable wall thickness of the guide tab (4) may be 0.5 mm, taking into account that the separation between consecutive teeth may range from 0.5 to 1.5 mm or more. However, the geometry of said guide tabs (4) can be modified into a wedge shape, for example, by sharpening the guide tap (4) section towards the corresponding tape, in order to help improve insertion between teeth (2) and to allow to increase the wall thickness of the tab as a most distant section of said tape is taken. That is, the slider according to the present invention preferably has said left (4*a*) and right guide tabs (4*b*) with their contact ends with said teeth (2*a*, 2*b*) a thickness equal to or less than the separation space (21) between consecutive teeth of the same tape, thus allowing to be interlocked without forcing the position of the teeth.

As shown in the figures (in particular in FIG. 5), said guide tabs (4*a*, 4*b*) protrude from the ends of the movable arms (18*a*, 18*b*). Said movable arms allow to position the guide tabs (4), which are best illustrated in FIG. 10, at a suitable distance with respect to the column (10) and the housing (13) acting together as an attaching device and at the same time as a separator of the rows of teeth (2), so that both rows of teeth (2*a*, 2*b*) can be conveniently guided in a "V" shape to open/close the fastener in a guided manner. Therefore, it is shown that there is a new way to achieve that said attachment device and said separator device of rows are combined in a column (10) in one of said portions of said slider and a housing implemented as a hollow pseudo-column (13) in the other portion of said slider, so since they are pivotally attached to each other they connect both portions (8, 9) of the slider (1), while allowing at the same time to modify the horizontal approaching distance existing between said left (4*a*) and right guide tabs (4*b*), and additionally it allows the column (10) and the housing (13) set to act together in order to act as a separator device (10, 13) of said rows of teeth. In particular, and according to a preferred embodiment, the hollow pseudo-column (13), which covers and embraces the column (10) in general will receive the pressure against both rows of teeth (2*a*, 2*b*) forcing them to separate. However, other means of separation of rows of teeth may be provided, without this being inconvenient for the purposes of the present invention, as for example, will be discussed in detail below, with the addition of complementary parts such as the cover part (25) best shown in FIG. 15, among other options.

Figure 9:
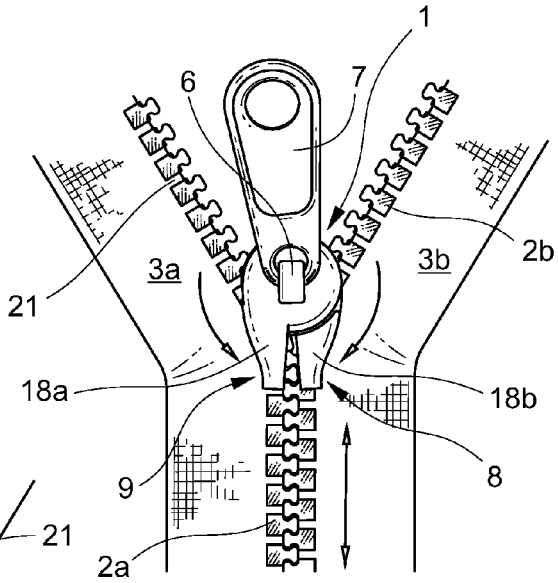
FIG. 9 is a top view according to FIGS. 7 and 8, having brought closer the guide tabs on both sides of the slider, i.e., having completed the proximity lock of the slider.

The same movable arms (18*a*, 18*b*), preferably configured so as to look aesthetically symmetrical, allow in turn to sufficiently move away the guide tabs (4*a*, 4*b*) to allow full insertion of the teeth (2) as shown in FIGS. 7 and 8, to subsequently approach the movable arms of the left reel (9) to the movable arms of the right reel (8) as illustrated in FIG. 9 by force fitting of the teeth (2), which are intercepted and pushed by both pairs of guide tabs (4*a*, 4*b*). In this situation, application of hand pressure on both pairs of movable arms (18*a*, 18*b*) until achieving full engagement between the teeth (2*a*, 2*b*) that are being pushed allows to commence partial recovery of the slide fastener. A repeated back and forth sliding movement of the slider (1) forward and backward over the rows of teeth (2*a*, 2*b*) simultaneously with the closing of the arms (18*a*, 18*b*) allows to complete the optimal operation or repair of the fastener as shown in said FIG. 9.

A convenient way of putting into practice the guide tabs (4*a*, 4*b*) is as illustrated in FIG. 10, as a smooth arch or curve, which allows it to tangentially accompany its push on the spine (24) of the teeth (2*a*, 2*b*) in a wide range of opening positions of the arms (18*a*, 18*b*) while helping to smoothly guide the sliding operation. Also, said left (4*a*) and right guide tabs (4*b*) that are inserted through the space (21) between consecutive teeth in their contact end with said teeth (2*a*, 2*b*) a thickness equal or less than the separation space (21) between consecutive teeth of the same tape, as best illustrated in the enlarged detail in FIG. 7*a*. The contact end with said teeth (2*a*, 2*b*) is the portion of said guide tabs that effectively push and channel each corresponding row of teeth (2*a*, 2*b*), especially the contact zone of the tabs with the spine (24) of the teeth (2*a*, 2*b*).

The way in which both pairs of arms (18*a*, 18*b*) and consequently the guide tabs (4*a*, 4*b*) remain fixed in a position appropriate for the size of the fastener being repaired or to which the user simply wishes to add one of said novel and inventive sliders, can be conveniently carried out by adding any locking means (20), which in a preferred embodiment and by way of example has been implemented in the back of the slider (1), and as best illustrated in FIGS. 4,6, and 11-13*b*, by a plurality of saw teeth (15) formed on both covers (11*s*, 11*i*) of the left reel (9), so as to properly interact with a wedge (16) formed at the end of a flexible arm (14) formed on both covers (12*s*, 12*i*) of the right reel (8), for example by making a curved groove (19) long enough to allow proper flexing of said flexible arm (14) unlocking the wedge (16) of the saw teeth (15) when both pairs of arms (18*a*, 18*b*) approach each other upon reducing the horizontal separation between the guide tabs (4*a*, 4*b*), as both oblique faces of the wedge (16) and of the saw-tooth shape (15) slide between them. And conversely, locking the position of the guide tabs (4) in a fixed slider measure when attempting to re-open both pairs of arms (18*a*, 18*b*). Thus, it is possible to adjust the slider (1) by pressing with your fingers both pairs of arms (18*a*, 18*b*) hearing, for example, the sound made by the change of measure of the slider with the successive "clicks" heard when the wedge (16) jumps over the saw teeth (15) until it is no longer possible to continue closing the horizontal separation between the guide tabs (4*a*, 4*b*) because they have already interlocked and the teeth have reached the end stop (2*a*) with the teeth (2*b*) that were being pushed when closing the pairs of arms (18*a*, 18*b*) with the fingers. In this way, the slider (1) remains inserted into the fastener and ready to be opened and closed without having to unsew or modify any seam or the garment or article of interest. According to the foregoing description it is clear that said locking means (20) allows to fix such horizontal approaching distance existing between said left (4*a*) and right guide tabs (4*b*), generally agreeing with the width (h) between interlocked teeth. When the slider (1) of the present invention opens and closes the fastener of an article such as bags, pockets, and other articles where the slider (1) never loses contact with both rows of teeth (2*a*, 2*b*) it is sufficient to ensure that the guide tabs (4*a*, 4*b*) do not move away from each other when fixed by the locking means (20), which in this case can only act in one direction, in the fastening or unfastening of said guide tabs (4*a*, 4*b*), as the slider (1) is unable to close its arms (18*a*, 18*b*) beyond the width (h) between interlocked teeth, and then the slider can be used as usual.

In case the slider (1), at some point, remains holding only by one of the rows of teeth (2*a* or 2*b*), as in the case of jackets, raincoats, coats and other articles completely separating the two portions of the garment or article with a slider fastener, said locking means (20) will act in both directions to ensure to keep the horizontal separation between the guide tabs (4*a*, 4*b*). This can be embodied, for example, with an opposing set of saw teeth (15') and a wedge (16') as illustrated in FIG. 13*b*, where said locking means (20) comprising both sets of wedge (16, 16') and sawtooth (15, 15'), may conveniently be unlocked depending on the direction of the movement wished to be obtained from each portion of the slider (1), to increase or decrease the horizontal approaching distance between the pairs of guide tabs (4*a*, 4*b*). In this case the locking means (20) secures the position of both arms (18*a*, 18*b*), even when the slider (1) remains hanging only from one row (2*a* or 2*b*). In the particular case illustrated in FIG. 13*b*, the set of saw teeth (15) and wedge (16) ensures that the slider cannot be opened, until unlocking the wedge (16) by pushing through the notch (28) and conversely, the set of saw teeth (15') and a wedge (16') ensures that the slider cannot be closed when the slider is held by a single row of teeth, but until unlocking the wedge (16') by pushing the notch (28'). Similar bidirectional locking mechanisms can be adopted in a variety of designs, including the possibility of immobilizing definitely both portions of the slider (1) for example, using adhesives, welds, screws or other fixed or movable teeth.

Also, and as best illustrated in FIG. 6, it is desirable to provide a portion or area in both covers (11*s*, 11*i*), shown with reference number (22) without the saw-teeth (15), so both moving parts (8, 9), i.e., the reels proposed herein as a first embodiment of the present invention, can open or close a convenient angle for comfortably maneuvering during the first stage of insertion of the guide tabs (4) through the separation space (21) between consecutive teeth (2), and it is also useful when removing the slider from the fastener, facilitating forthright the action of handling and finally removing the same.

Figure 12:
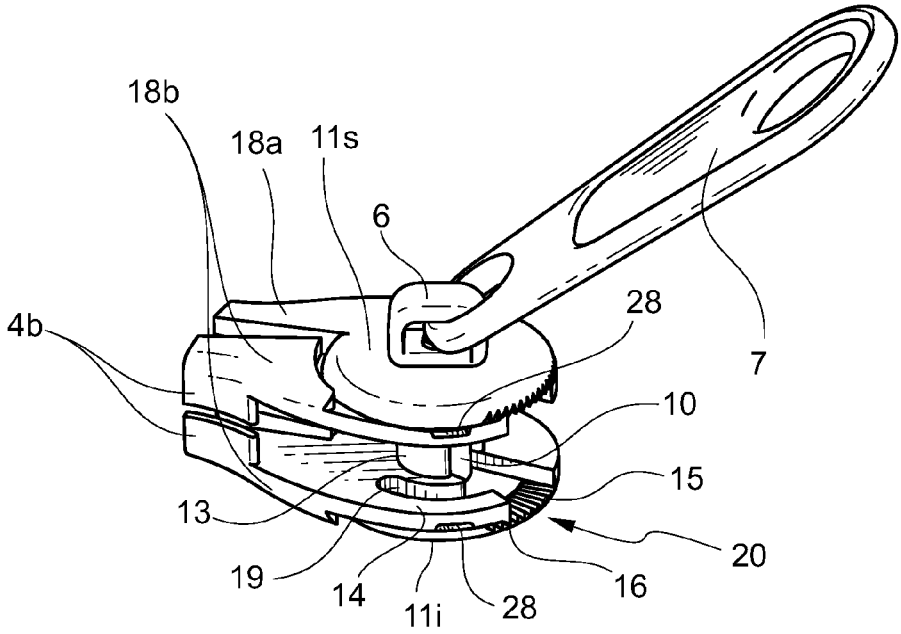
FIG. 12 is a perspective view and from one side of the slider of the present invention illustrating in greater detail the component parts of the slider according to the first preferred embodiment.
Figure 13A:
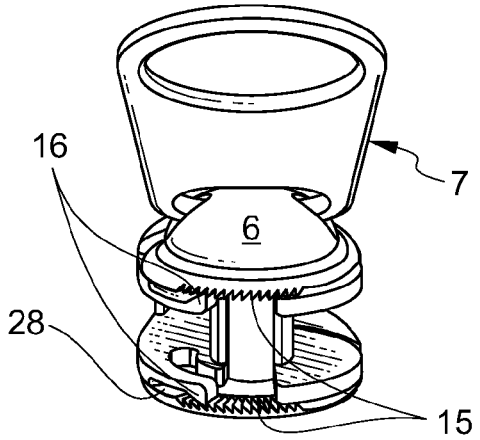
FIGS. 13*a* and 13*b* are rear views of the slider of the present invention, illustrating two possible variations of the lock means that adjusts the slider to a specific size.
Figure 13B:
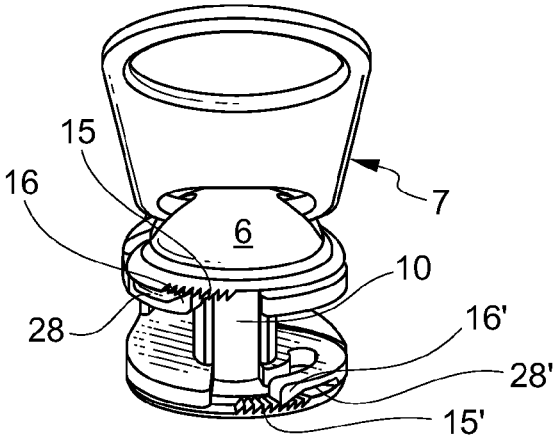

Among other accessory functions of the slider of the present invention and as exemplified in FIGS. 12 and 13*a*, it is possible to add said notch (28) so as to allowing to insert the tip of a screwdriver or a nail of the user to unlock the wedge (16) and reopen the arms (18*a*, 18*b*) of the slider for a fastener. It is also possible to add some type of push button to unlock the locking device (20). We prefer those unlocking devices which cannot be accidentally operated, requiring to pull a knob in one direction, a direction and position that the pull knob would not take during its normal daily use.

Other locking means designs (20) of both pivoting parts (8, 9) may be added to the slider of the present invention to ensure the final working position of the slider. However, we prefer those locking devices (20) allowing an easy complete opening of both reels (8, 9) when opening the arms (18) for its insertion into the fastener and allowing to adjust the final measure by manual operation and without any tool as in the case of the saw teeth and locking wedge in fasteners either separating or not both rows of teeth.

However, as a person skilled in the art will understand, other equivalent locking devices can be used, even with the addition of small setting screws, whether positioned in the rear of the slider, for example at the end portion of the arms; it is also possible to use some kind of tightening and locking by friction and even to secure the final position by means of adhesives, elastic pushers, magnets, springs, etc.

Figure 19:
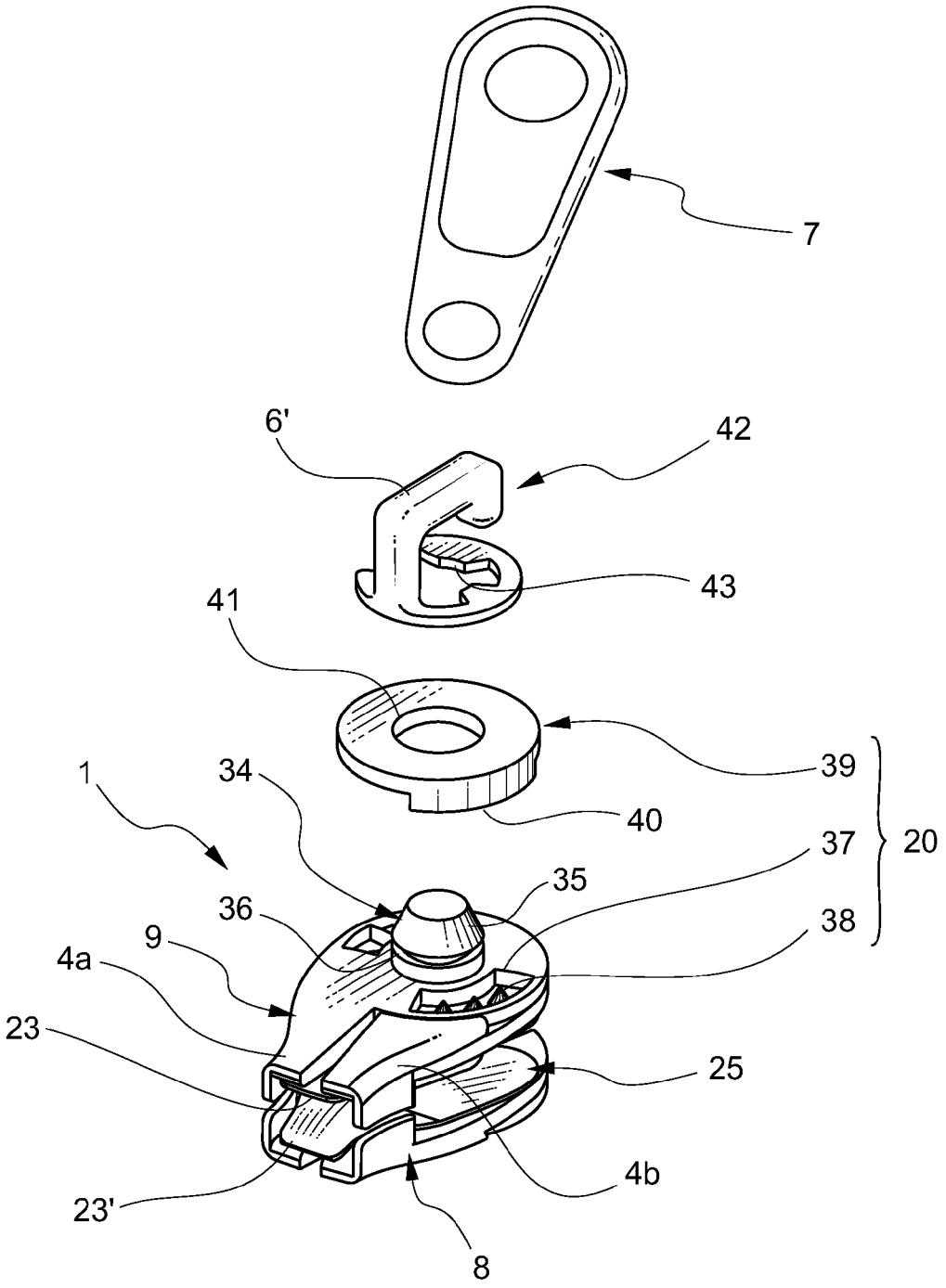
FIG. 19 is a perspective view, and, being the parts semi-assembled, illustrates yet another embodiment of the present invention, wherein the locking means ensure that the horizontal approaching distance existing between the left and right guide tabs and define the size of the fastener to which the slider adapts is formed by a mechanism based on plungers that press and notch an elastomeric piece and/or the like, which shall be fully described, as well as the other figures mentioned above, in the detailed description of the invention below.

In this regard, and in order to help clarify that other locking devices (20) may be applied to the slider of the present invention, and to help understand why the above-mentioned set of opposing saw teeth (15') and wedge (16') for the purposes of the present invention is merely a preferred embodiment, but not limiting to embody the locking means (20) that allows fixing said horizontal approaching distance between said left and right guide tabs (4*a*, 4*b*), a new preferred embodiment is shown in FIG. 19.

Said FIG. 19, by way of example, illustrates another preferred embodiment where the aforementioned locking means (20) is now put into practice by the interaction of a plurality of pointed protrusions (38), which can also be defined as spikes, or simply tips hovering through an arc-shaped groove (37) or similar, a geometry better known also as circular trapeze, formed on the top cover of the left portion (9) of the slider (1). Therefore, said locking means (37, 38, 39), referred to above with reference number (20) comprises at least one pointed protrusion formed on one of the covers of the right portion (8) of the slider, and more preferably a plurality of pointed protrusions (38), and even more preferably three pointed protrusions, where at least one pointed protrusion (38) pokes through a groove (37), preferably with a circular trapeze shape formed on one of the covers of the left portion (9) of the slider such that an interlocking part (39) which includes at least one resilient block (40), can reach the groove (37) to insert said resilient block (40) in said groove (37) so said resilient block (40) is thrust/pronged by at least one pointed protrusion (38), of course, because the resilient block (40) is made of an elastomeric material, such as rubber or the like so as to be thrust or pronged by at least one pointed protrusion (38) when said resilient block is pressed (40) against the cover of the right portion (8) containing the pointed protrusion(s) (38).

The plungers or thrusting points (38) rotate solidarily with the right portion (8) and the groove (37) rotates solidarily with said left portion (9). As mentioned above, there is an interlocking part (39) made of a material which preferably may be strained due to the penetration of the plungers (38), such as those made of elastomeric materials such as rubber and the like, allowing the insertion of the resilient block (40) in the circular trapeze or arc-shaped groove (37) holds the relative rotation between both portions (8, 9) of the slider (1), because the left portion plungers (8) nailed to the material of the resilient block (40) cannot rotate with respect to the arc-shaped groove (37) in the right portion (9) that holds the resilient block (40). Thus, it is possible to obtain a device to lock the rotation (20) which allows the accurate adjustment of the horizontal approaching distance existing between said left and right guide tabs (4*a*, 4*b*), by just pressing the interlocking part (39) against the top of the main body of the slider (1) once obtained the desired configuration. Also, to ensure and keep the interlocking part (39), which includes the arc-shaped protrusion (40) and/or even being it only formed by the resilient block itself with a circular trapeze shape (40), there is a clamping part (42), more or less complex, which can be easily connected when pressed against a protrusion (34) of the left portion (9) including a taper (35) which allows the opening (43) of said clampling part (42) to sufficiently and elastically flex to open said opening (43) until the incomplete flexible ring surrounding the opening (43) fits into the circumferential groove (36) of said protrusion or rock-bolt (34). Upon securing the clamping part (42) through the groove (36), the same is able to press the interlocking part (39), which includes a central hole (41) or at least one elastomeric part with circular trapeze shape (40), which fits tightly into the circular trapeze shaped groove (37), ensuring as locking means the horizontal approaching distance existing between said left and right guide tabs, while keeping the rotation freedom of the clamping part (42). The clamping part (42) may further include an ear or ring (6'), preferably incomplete and as a hook to allow to insert and hold the pull knob (7), thus forming the complete slider. Therefore, based on what has been illustrated by way of example, in said FIG. 19, it is clearly possible to embody said locking means allowing to fix said horizontal approaching distance between said left and right guide tabs, in another preferred embodiment, without this being any limitation to the purposes of the present invention.

It is worth mentioning that for the purposes of the present invention, although we have described and illustrated an interlocking part (39) of the type comprising a type of washer with a through hole (41) and a resilient block (40), it is obvious to a person skilled in the art that it is possible to provide only said resilient block (40) to be inserted into the groove (37) as it is ultimately the part that interlocks together with the other components of the locking means (20) without this representing any substantive difference with respect to what has been described and illustrated above; therefore, for the purpose of the present invention, the interlocking part (39), either with a washer and a resilient block or just with a resilient block with a circular trapezoidal section, (in the latter case it can be completely hidden within the circular trapeze-shaped groove), for purposes of the present invention are merely equivalent embodiments. In this regard, terms such as "the interlocking part that includes a resilient block" is at least formed by said resilient block (40) and may or may not have an additional washer, integrated or not to said resilient block (40).

Finally, regarding the attaching device connecting both parts, it is noteworthy that the same can be embodied by any other means equivalent to the one described above based on a pivotal movement, such as via a horizontal sliding mechanism between parts, for example, without any pivoting movement, and other options that may be obvious to a person skilled in the art relying on the benefits of what is being disclosed herein with reference to this new slider (1).

Method for Inserting a Slider between both Rows of Teeth of the Stringer Tapes to Manufacture and/or Repair a Slide Fastener.

As seen in the sequence of illustrations of FIGS. 7 to 9, this new slider for a slide fastener can be also installed in a slide fastener in a novel manner, usually by inserting it through the teeth and not by resorting to the vertical opening of the slider itself to avoid interference with the teeth (2).

In this regard, and as a person skilled in the art will understand, it is possible to identify and define a method for inserting a slider for a slide fastener which conveniently comprises the following steps:

a) inserting the pair of guide tabs (4*a*, 4*b*) of each portion (9, 8) of said slider (1) through the separation space (21) between consecutive teeth (2*a* or 2*b*) so that each pair of left (4*a*) and right guide tabs (4*b*) completely passes through the element width (2*a* or 2*b*) of the corresponding left (3*a*) and right stringer tape (3*b*) on which they have been inserted, b) bringing together said left portion (9) and said right portion (8) such that said guide tabs (4*a*, 4*b*) of said left portion (9) and said right portion (8) have an approaching distance corresponding to the width (h) of the interlocked teeth of both stringer tapes;

wherein said locking means (20) allows fixing said horizontal approaching distance existing between said left (4*a*) and right guide tabs (4*b*), and wherein said locking means (20) has an unlocking means (28 and/or 28') of said horizontal approaching distance, actionable so as to allow to open or close said slider (1) when said unlocking means (28 and/or 28') is actioned.

Therefore, the slider for a slide fastener according to the present invention has a unique and distinctive method of application to be installed in a garment, article and the like, having defined in this way, and as mentioned above a method related to the application of said slider, and that is only possible thanks to the properties of this new slider. On the other hand, having defined the way that the slider can be inserted, it will be obvious to anyone with average skills in the use of clothing and articles to remove the slider from the garment or article if so needed following the reverse steps.

Aesthetic Covers of the Slider

In case of requiring, for aesthetically reasons, to cover the separation existing between the arms (18*a*, 18*b*) through which the teeth can be seen; separation or opening shown in FIG. 9, different designs can be applied such as the incorporation of metal, or plastic sheets or any other suitable material (23) (See FIGS. 1, 11, and 14) as a cover of the teeth, held between the arms (18*a*, 18*b*) both on the top and bottom of the slider. Also, these sheets, preferably metal sheets, surprisingly can help channel and confine the passage of the teeth when the same are being interlocked to close the fastener, providing an additional benefit with its addition.

Figure 14:
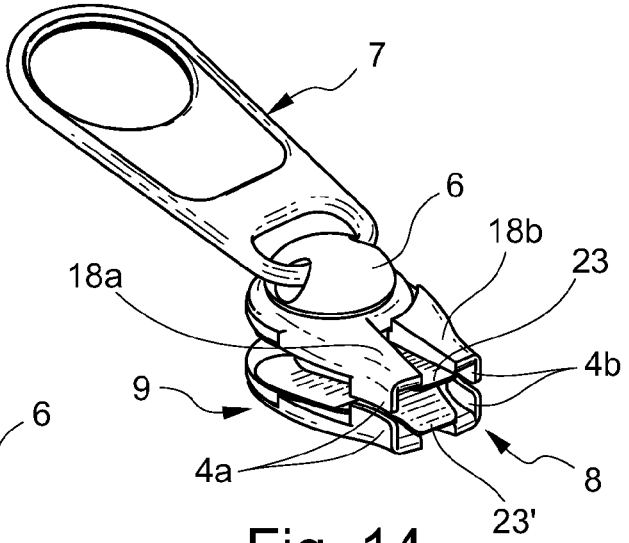
FIG. 14 is a perspective view of a second embodiment of the slider of the present invention which includes a rotating pull knob and an intermediate coverage piece.
Figure 15:
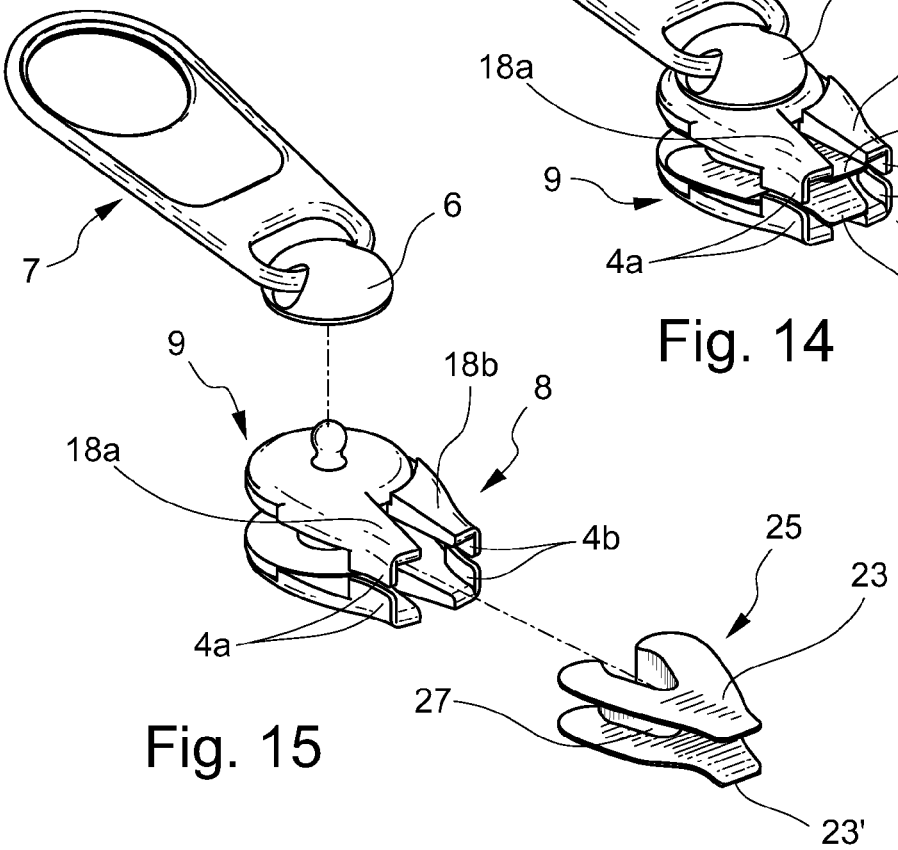
FIG. 15 is a perspective view according to FIG. 14, where certain slider parts are disassembled/separated for purposes of clarity.

Just by way of example, FIGS. 14 and 15 illustrate a second possible embodiment of a slider (1) according to the present invention, with portions (8, 9) pivotally connectable by means of a hinge which acts as a means of attachment of both portions and also as a splitting or disengaging agent of teeth, so to allow for the adjustment of the horizontal distance between the left (4*a*) and right (4*b*) guide tabs, where the locking means can be, for example, of the same type as used in the first embodiment example, using a grooved surface with the shape of saw-tooth and wedge, or the like. Additionally to said configuration, a cover part (25) is provided, which is attachable to the pseudo-column (13) by means of a guiding holder (27) typically in the shape of a "V" letter with the purpose of helping in the separation of the rows of teeth (2*a*, 2*b*), where the rows of teeth (2*a*, 2*b*) will help the cover part (25) itself. Said cover part (25), includes protrusions (23, 23') serving as an aesthetic cover of the gap between arms (18*a*, 18*b*) and also contribute to guiding the rows of teeth (2*a*, 2*b*), since they can exert a slight vertical compression on slide fastener teeth. Said protrusions (23, 23') act as tabs, and can adopt several shapes, as for example is illustrated for the lower tab (23'), which has a slightly curved shape, to exert a light pressure from below on the rows of teeth, so to confine tightly the teeth (2) and help the slider (1) to adapt itself to different geometries and types of slide fastener teeth. Therefore it is observed that said at least one cover part (25) gets in contact with said rows of teeth (2) at least from above or below, more particularly, and according to one preferred embodiment said protrusions (23, 23') get in contact with said rows of teeth at least from above or below; and even more preferably from above and simultaneously from below of said rows of teeth.

Among other options, said part (25) can contribute to incorporate and/or be part of the locking means (20) which keeps the horizontal distance existing between said left (4*a*) and right (4*b*) guide tabs. Additionally said part can be used as an internal locking means preventing the accidental opening of the slide fastener, as said part can be introduced between the teeth that are travelling inside the slider, therefore the blocking exerted on said teeth would prevent the accidental opening of the slide fastener, unless said part is deliberately released between the teeth, thus not interfering with the free movement and sliding of the slider along the slide fastener.

Figure 16:
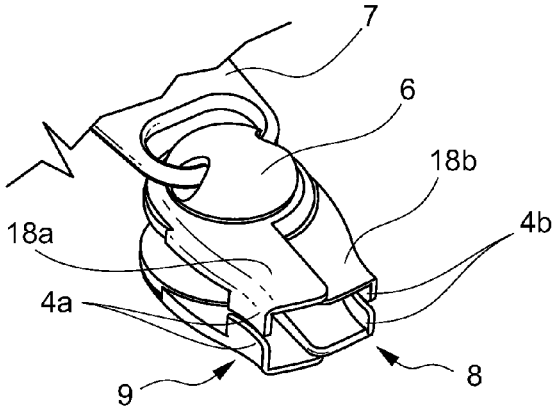
FIG. 16 is a perspective view of the slider of the present invention according to a third preferred embodiment, showing that the aesthetic cover is achieved in one of the maximum opening positions desired by means of the arms of both portions of the slider, overlapping both arms, also
Figure 16A:
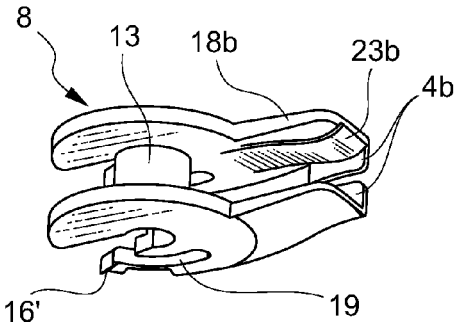
FIG. 16*a* illustrates one half of the slider, in particular its right half showing by way of example an embodiment of the complementary vertical guide tabs integrally manufactured on said right half of the slider itself, so as to show that the cover part 25 illustrated in FIG. 15 can be fully integrated on both sides of the slider, without this being an obstacle for the purposes of the present invention.
Figure 17:
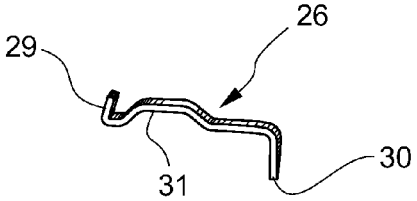
FIG. 17 is a perspective view and generally taken from one side, which shows the incorporation of a hook-back of said slider on the slide fastener, implemented by a tooth-shaped elastic spring illustrated in detail also separated and above its own figure by way of example.
Figure 17:
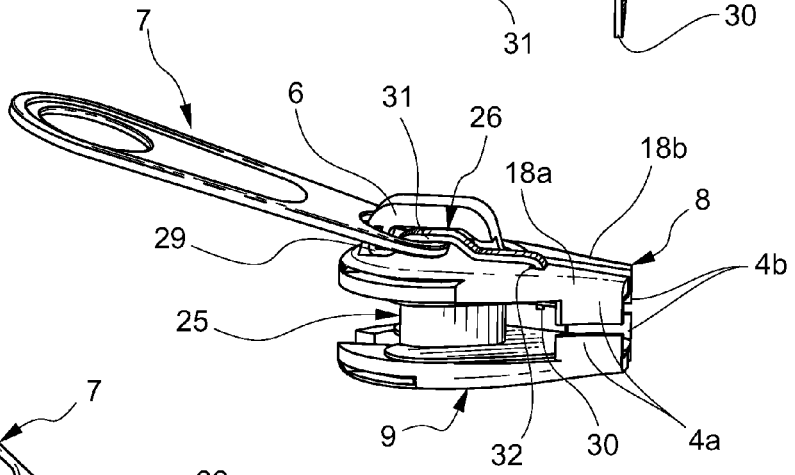

Additionally, in FIG. 16 a third possible embodiment of the slider (1) according to the present invention is illustrated, which typically maintains the structure with two portions (8, 9) connectable by means of a pivotal joint acting as a means of attachment of both portions and at the same time as a disengaging or separating agent of rows of teeth, so to allow the adjustment of the horizontal distance existing between the left (4*a*) and right (4*b*) guide tabs, where the locking means can be of the same type as used in the first embodiment example, or of any other type as will be described in detail below, formed by a grooved surface with teeth of saw-tooth and wedge or equivalent. In this configuration, modified arms (18*a*, 18*b*) as compared to those in the first embodiment examples are provided, that extend so to overlap and act as a cover of the gap between said arms when they move away from each other, that is, when the horizontal distance between the left (4*a*) and right (4*b*) guide tabs increases up to the greatest dimensions of the dimension range to which the slider (1) is intended. The examples of cover of the gap between arms can be obtained in the ways previously mentioned and/or in other ways, types or accessories deemed fit, neither of which imply a limitation to the present invention. Additionally said cover part (25) can be composed by more than one portion connectable to each other or to the slider para slide fastener and at least one cover part (25) can be incorporated, so that said at least one cover part comprises one upper cover part and one lower cover part, between other options. Even more, said arms (18*a*, 18*b*) also can be integrated to said cover part (25) not only to act as a cover but also to incorporate the protrusions (23, 23') which contact said rows of teeth at least from above or from below integrally therewith, as partially illustrated in FIG. 16*a*, which shows one right portion of the slider of FIG. 16, illustrating one way in which at least one of said protrusions or tabs (23,23') can be integrally incorporated in the arms (by way of example, the arm 18*b* in the FIG. 16*a*) to additionally help in guiding the slide fastener teeth in the vertical direction. FIG. 16*a* shows that it is possible to integrally provide, to any of the two portions (8, 9), more preferably next or on the inner portion of the arms (18*a*) and/or (18*b*) forming the slider (1), the tabs which exert a light vertical pressure to help the passage of the teeth when they are of lesser height; and this is made possible by providing for example at least one typically flexible protrusion or strip (23*b*) inside the arm (18*b*) in the example of FIG. 16*a*, with a free end (the innermost end for the case shown in said figure), acting as a spring on the upper portion of the teeth of the slide fastener, thus emulating the function of the cover part (25) when it acts as a guide by exerting a light vertical pressure above and/or below the teeth, especially when the fastener teeth get close and attach to each other to effect the closure of the slide fastener. It is then apparent that the elastic protrusions or tabs (23, 23') can be integrally manufactured with one or both portions (8,9) of the slider, preferably in each one of the arms (18*a*, 18*b*). It is therefore possible that said left portion (9) and said right portion (8) have each of them at least one flexible tab (23 or 23') integrated to at least one of said portions and where said at least one tab (23*b*) gets in contact with said rows of teeth at least from above or from below.

Additionally, and according to a fourth preferred embodiment or design of the present invention which is given only by way of example, a slider (1) is provided which typically has the structure with two portions (8, 9) connectable by means of a pivotal joint acting as a means of attachment of both portions and disengaging or deparating agent of the rows of teeth, so to allow the adjustment of the horizontal distance existing between the left (4*a*) and right (4*b*) guide tabs, where the locking means can be of the same type as used in the first embodiment example, formed by a grooved surface of saw-tooth and wedge elements or equivalent. In this configuration, a ring (6) is provided, preferably connected to the left portion (9) of the slider, adapted as illustrated in the figure to receive an elastic spring (26), which shape is adapted to have an attaching end (29) and a protruding portion (30) to lock the teeth (2). Said elastic spring (26) acts as a retention means of the slider (1) on the slide fastener, since when the protruding portion (30) projects into the slider, it is inserted between the teeth (2) thus preventing the movement of the slider (1) itself, therefore preventing for example the accidental opening of the slide fastener in use, for example when used in trousers or coats.

Said retention means of the slider on the slide fastener, is given by way of example only for reference, intending to illustrate that there is no problem in providing this particular slider (1) with fixing means, if necessary. In particular, as an expert in the art will appreciate, when pulling the pull tab (7), the portion (31) of the spring itself is pushed upwards, therefore the protruding portion (30) withdraws by sliding through the opening (32) on one of the portions of the slider (1) and the cover part (25) thus eliminating the interference with the teeth (2), so that by simply pulling the pull tab (7), the slider (1) will be released. Conversely, upon ceasing the pull on the pull tab (7), the elasticity of the spring (26), causes the protruding portion (30) towards the inner part of the slider (1) and interferes again with the teeth, thus automatically locking the slider (1).

Figure 18:
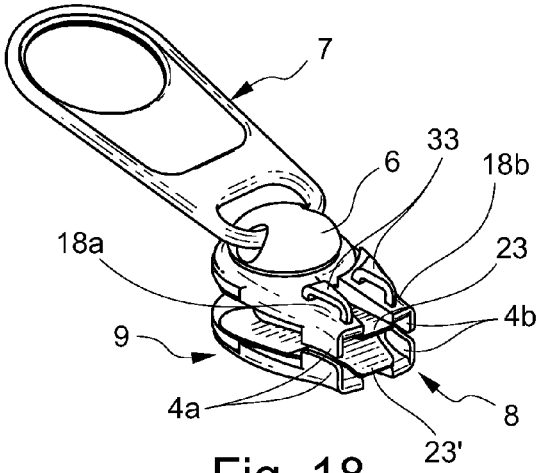
FIG. 18 illustrates in perspective yet another embodiment of the slider of the present invention, which incorporates some rings for the passage of one or more seals, for the purpose of security against theft.

Additionally, according to what is shown in FIG. 18, the slider (1) of the present invention can also include rings (33) in both the left (9) and right (8) portions, so to allow the use of one or more security seals, or any other appropriate security element to avoid the theft of the slider, for example, in closed position of the arms of the slider (1); position in which both rows of teeth (2) are engaged in normal use of the slide fastener. This way, the provision of rings (33) as a means of passage for a security seal or other security element, allow to prevent that the slider (1) could be easily or illegally removed from the clothing article. It is understood that said rings, acting as a means of passage for at least one security seal or other equivalent security means can be put into practice in more than one way, such as an expert in the field will appreciate, for example, by means of simple openings on each said portions (9, 8) of the slider, etc. Additionally said rings (33) or simple openings can be used for a variety of other purposes such as the addition of tags with information from the manufacturer, for example about a clothing article or article being exhibited which comprises said slider for slide fastener, as well as the insertion of labels with information about the brand name, country of origin, materials and/or anti-theft alarm systems for a garment or article, among other applications.

According to what has been described and illustrated above in the figures and the exemplary design embodiments, it will become apparent for an expert in the art that it is possible to put into practice the novel slider (1) of the present invention in more than one embodiment, by incorporating one or more of the variations herein described, which are applicable to the main construction, as set forth in the appended claims.

What is claimed is:

1. A slider (1) for a slide fastener of the type used to slide along a pair of rows of teeth (2*a*, 2*b*) engageable to each other, wherein each row of teeth is supported by corresponding textile tapes (3*a*, 3*h*) or flexible bands acting as stringer tapes for said teeth (2), being said stringer tapes typically attached to a longitudinal opening of any kind of garment or article, either by means of seams, adhesives or the like in order to obtain the longitudinal closure or opening of said opening, wherein said slider is characterized by comprising:

a left portion (9) including a pair of left guide tabs (4*a*) vertically separated from each other by a gap (S) for the passage of said stringer tape (3*a*) of said teeth (2*a*), a right portion (8) including a pair of right guide tabs (4*b*) vertically separated from each other by the gap (S) for the passage of said stringer tape (3*b*) of said teeth (2*b*), wherein said left portion (9) and said right portion (8) are connectable to each other through a means of engagement (10,13) so that said guide tabs of said left portion and said right portion can come horizontally closer or farther, thus adopting different horizontal approaching distances (h) therebetween, a separating means (10,13) for said rows of teeth, a locking means (20) allowing to fix said horizontal approaching distance (h) existing between said left and right guide tabs (4*a*), 4*b*), and wherein each of said left and right guide tabs have in their contact end with said teeth a thickness that is equal or less than the separation gap between consecutive teeth of the same stringer tape.

2. The slider according to claim 1, characterized in that said means of attachment and said row separation means are combined under the form of a column in one of said portions of said slider and a housing in the other portion of said slider, being said portions pivotally connected to each other.

3. The slider according to claim 1, characterized in that said left portion and said right portion have a general shape of a reel, so to include an upper cover and a lower cover from which corresponding arms extend and support respective teeth guide tabs of said portions, wherein the upper and lower covers of one of said portions are comprised between the upper and lower covers of the other portion of said slider.

4. The slider according to claim 1, characterized in that said locking means comprise a saw-tooth shaped surface on one of said portions of said slider and a wedge shape on the other portion of said slider, so to lock said horizontal distance existing between said left and right guide tabs at least in the direction in which said left and right guide tabs move away from each other.

5. The slider according to claim 1, characterized in that said locking means comprises at least one pointed protruding portion on one of the covers of the right portion of the slider, where said at least one pointed protruding portion projects through an opening on one of the covers of the left portion of the slider, so that one locking part comprising at least one resilient block can be inserted into said opening, being said resilient block capable of being compressed by said at least one pointed protruding portion.

6. The slider according to any of claim 1, characterized in that at least one cover part is included between said left portion and said right portion.

7. The slider according to claim 1, characterized in that at least one cover part is included between said left portion and said right portion contacting said rows of teeth at least from above or from below.

8. The slider according to claim 1, characterized in that said left portion and said right portion each comprise at least one flexible tab integral to at least one of said portions and which gets in contact with said rows of teeth at least from above or from below.

9. The slider according to claim 1, characterized in that at least one of said portions of said slider has its arm protruding far enough so as to overlap and cover the gap formed between said arms along said horizontal distance between said left and right guide tabs.

10. The slider according to claim 1, characterized in that one of said portions is pivotally connectable with a pull tab.

11. The slider according to claim 1, characterized in that said locking means comprise a saw-tooth shaped surface on one of said portions of said slider and a wedge shape on the other portion of said slider, so to lock said horizontal distance existing between said left and right guide tabs at least in the direction in which said left and right guide tabs move away from each other, and further comprise a surface having a saw-tooth shape on one of said portions of said slider and a wedge in the other portion of said slider, so to lock said horizontal distance existing between said left and right guide tabs at least in the direction in which said guide tabs left and right get closer to reach other, and wherein said locking means comprises a releasing means of said locking means, both for opening and closing.

12. The slider according to claim 1, characterized in that said slider includes at least one retention means of said slider on the slide fastener.

13. The slider according to claim 1, characterized in that said left and right guide tabs have the shape of an arch.

14. A method for the insertion of a slider for a slide fastener according to claim 1, comprising the steps of:

a) inserting the pair of guide tabs of each portion of said slider through the separation gap between consecutive teeth so that each pair of left and right guide tabs completely traverses the width of the element of its corresponding left and right stringer tape in which they have been inserted, b) positioning said left portion and said right portion close enough so that said guide tabs of said left portion and said right portion adopt a horizontal distance corresponding to the width of the engaged teeth of both stringer tapes;

wherein said locking means allow to fix said horizontal distance existing between said left and right guide tabs, and wherein said locking means comprise a releasing means of said horizontal distance, operable to allow the opening or closing of said slider when said releasing means are actuated.

* * * * *